United States Patent [19]

Vogel

[11] Patent Number: 4,651,658

[45] Date of Patent: Mar. 24, 1987

[54] SEWING MACHINE AND MEANS FOR TRANSPORTING WORKPIECES THEREIN

[75] Inventor: Peter Vogel, Walzenhausen, Switzerland

[73] Assignee: Fritz Gegauf Aktiengesellschaft Bernina-Nähmaschinenfabrik, Steckborn, Switzerland

[21] Appl. No.: 857,025

[22] Filed: Apr. 29, 1986

[30] Foreign Application Priority Data

May 3, 1985 [CH] Switzerland ..... 01889/85

[51] Int. Cl.[4] ..... D05B 11/00

[52] U.S. Cl. ..... 112/118; 112/303; 112/305

[58] Field of Search ..... 112/118, 117, 102, 86, 112/90, 303, 305

[56] References Cited

U.S. PATENT DOCUMENTS

| | | | |
|---|---|---|---|
| 3,465,697 | 9/1969 | Gerlach et al. | 112/118 |
| 3,960,095 | 6/1976 | Story | 112/118 |
| 4,006,697 | 2/1977 | Robertson | 112/118 |

FOREIGN PATENT DOCUMENTS

| | | | |
|---|---|---|---|
| 106810 | 4/1984 | European Pat. Off. . | |
| 2154360 | 5/1973 | Fed. Rep. of Germany | 112/117 |
| 3002340 | 1/1981 | Fed. Rep. of Germany . | |

*Primary Examiner*—H. Hampton Hunter

*Attorney, Agent, or Firm*—Peter K. Kontler

[57] ABSTRACT

An elongated workpiece is transported forwardly and backwards in a sewing or stitching machine by looping it upstream and downstream of the sewing or stitching station, by maintaining both loops under tension, by increasing the size of the downstream loop simultaneously with a reduction of the size of the upstream loop, and vice versa.

16 Claims, 6 Drawing Figures

SEWING MACHINE AND MEANS FOR TRANSPORTING WORKPIECES THEREIN

BACKGROUND OF THE INVENTION

The present invention relates to sewing machines in general, and more particularly to improvements in machines wherein the workpiece must be moved back and forth (forwardly and backwards) during treatment at the thread-applying station. The invention also relates to means for transporting workpieces in sewing machines of the just outlined character.

European patent application No. 106 810 discloses a stitching machine wherein the workpiece is tensioned and is caused to move backwards (a) by a pair of rollers which clamp the workpiece downstream of the stitching station and (b) by a dancing roll or pulley which is caused to tension the workpiece upstream of the stitching station so as to take up the slack which develops during rearward transport of the workpiece. The dancing roll is set in motion by a rack and pinion drive which causes it to store a length of the workpiece and to subject such length of the workpiece to a predetermined tension. A drawback of this proposal is that the machine cannot move the workpiece back and forth with a requisite degree of accuracy because the clamping and advancing action of the aforementioned rollers varies as a function of changes in the diameter and in the mass of the supply of convoluted workpiece material which is to be treated in the machine. Moreover, the force with which the rollers draw the workpiece depends on the inertia of moving parts and on the degree of accuracy with which the dancing roller is moved by the rack and pinion drive. When the workpiece is moved backwards, it is acted upon only by the roll which is shifted by the rack and pinion drive regardless of eventual fluctuations of one or more parameters such as the quality of the workpiece, the thickness of the workpiece and others. Consequently, tension in the length of the workpiece which is adjacent to the treating station changes to thus influence the quality of the pattern which is stitched, embroidered or otherwise formed in the workpiece.

German Offenlegungsschrift No. 30 02 340 discloses a modified sewing machine wherein a first pair of clamping rollers is provided upstream and a second pair of clamping rollers is provided downstream of the treating station. A drawback of such proposal is that the inertia of the supply of convoluted workpiece material affects the forward transport of the workpiece but is not a factor when the workpiece is caused to move backwards. This prevents the machine from making patterns with a required degree of predictability and reproducibility because it is not possible to advance one and the same increment of the workpiece back into a position of accurate register with the needle or needles upon completion of one or more rearward steps.

OBJECTS AND SUMMARY OF THE INVENTION

An object of the invention is to provide novel and improved means for transporting an elongated workpiece forwardly and backwards in a stitching, embroidering or like sewing machine.

Another object of the invention is to establish at the treating station of a sewing machine optimum conditions for predictable forward and rearward transport of the workpiece.

A further object of the invention is to provide means which ensures that the sewing machine can provide the workpiece with a series of patterns of stitches with a heretofore unmatched degree of reproducibility.

An additional object of the invention is to provide a sewing machine wherein the influence of inertia upon the workpiece during each forward movement upon the accuracy and predictability of such movement is minimal and wherein the circumstances prevailing during and/or preparatory to forward transport of the workpiece are at least substantially identical with those prevailing during and/or preparatory to rearward transport of the workpiece.

Still another object of the invention is to provide the sewing machine with one or more compact, simple and inexpensive treating units whose bulk and inertia are low and which are capable of providing the workpiece with a series of identical patterns of stitches.

An additional object of the invention is to provide a novel and improved arrangement of rollers, rolls and drive means therefor which can be utilized to accomplish the preceding objects in a simple and inexpensive way.

A further object of the invention is to provide sewing machine whose operation is more accurate than that of heretofore known sewing machines and whose operation can be automated to any desired extent.

Still another object of the invention is to provide the machine with novel and improved means for taking up the slack in an elongated workpiece upstream and downstream of each treating station.

A feature of the invention resides in the provision of a machine for applying stitches to an elongated workpiece. The machine comprises a frame, a source (e.g., including a set of two or more reels carrying convoluted webs of textile material) which is arranged to pay out the workpiece, a work collecting device (e.g., a takeup reel) serving to receive the workpiece which is being paid out by the source, at least one treating unit in the frame, and means for guiding and advancing the workpiece along a predetermined path intermediate the source and the collecting device and past the one treating unit. Such guiding and advancing means is mounted in the frame and includes a first pair of rollers defining for the workpiece a first nip intermediate the source and the one treating unit, a second pair of rollers defining for the workpiece a second nip intermediate the one treating unit and the collecting device, a first advancing roll which serves to advance the workpiece forwardly and backwards intermediate the rollers of the first pair and the one unit, a second advancing roll which serves to advance the workpiece forwardly and backwards intermediate the one treating unit and the rollers of the second pair, a first dancing pulley which serves to provide the workpiece with a first loop intermediate the rollers of the first pair and the first advancing roll, and a second dancing pulley which serves to provide the workpiece with a second loop intermediate the second advancing roll and the rollers of the second pair.

The guiding and advancing means preferably further comprises a first additional advancing roll which defines with the first advancing roll a third nip for the workpiece, and a second additional advancing roll which defines with the second advancing roll a further nip for the workpiece.

The machine further comprises motor means for the advancing rolls, levers or other suitable means for supporting the dancing pulleys so that each pulley is movable along a discrete path in response to a lengthening or shortening of the respective loop, and means for controlling the operation of the motor means including switches or other suitable actuating elements adjacent to at least one of the discrete paths.

The first and second advancing rolls, as well as the first and second additional advancing rolls, can be disposed at the same level. The advancing rolls can be driven (clockwise or counterclockwise) in synchronism by a reversible stepping motor or the like.

The one treating unit can comprise at least one mobile needle at one side of the predetermined path, at least one mobile work gripping device at the other side of the predetermined path, first drive means for reciprocating the needle, second drive means for reciprocating and/or otherwise moving the gripping device, and a control circuit or other suitable means for synchronizing the operation of the first drive means with the operation of the second drive means.

The needle and the gripping device are preferably movable transversely of the predetermined path, and the machine then further comprises means (e.g., including a reversible motor which is operated in response to signals from the control circuit) for moving the needle and the gripping device transversely of the predetermined path in synchronism with each other. The moving means can comprise at least one feed screw, at least one motor-driven endless chain, at least one metallic band or any other suitable means for ensuring predictable displacement of the needle and of the gripping device transversely of the path of movement of the workpiece past the one treating unit.

The machine can comprise a second treating unit upstream or downstream of the one treating unit i.e., adjacent to the predetermined path intermediate the collecting device and the rollers of the second pair or intermediate the source and the rollers of the first pair. Such machine then further comprises a third pair of rollers defining for the workpiece a nip intermediate the source and the second unit or intermediate the second unit and the collecting device, a third advancing roll which serves to advance the workpiece forwardly and backwards intermediate the rollers of the third pair and the second unit or intermediate the rollers of the first pair and the second unit, a fourth advancing roll arranged to advance the workpiece forwardly and backwards intermediate the second unit and the rollers of the first or second pair, a third dancing pulley which serves to provide the workpiece with a third loop intermediate the rollers of the third pair and the third advancing roll or intermediate the rollers of the first pair and the third advancing roll, and a fourth dancing pulley which serves to provide the workpiece with a loop intermediate the fourth advancing roll and the rollers of the first or second pair.

The source can comprise a plurality of supply reels each of which can feed a discrete portion (e.g., an elongated web) of the workpiece into the predetermined path.

The advancing rolls are preferably horizontal and their axes can be disposed in a common horizontal plane.

The novel features which are considered as characteristic of the invention are set forth in particular in the appended claims. The improved sewing machine itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
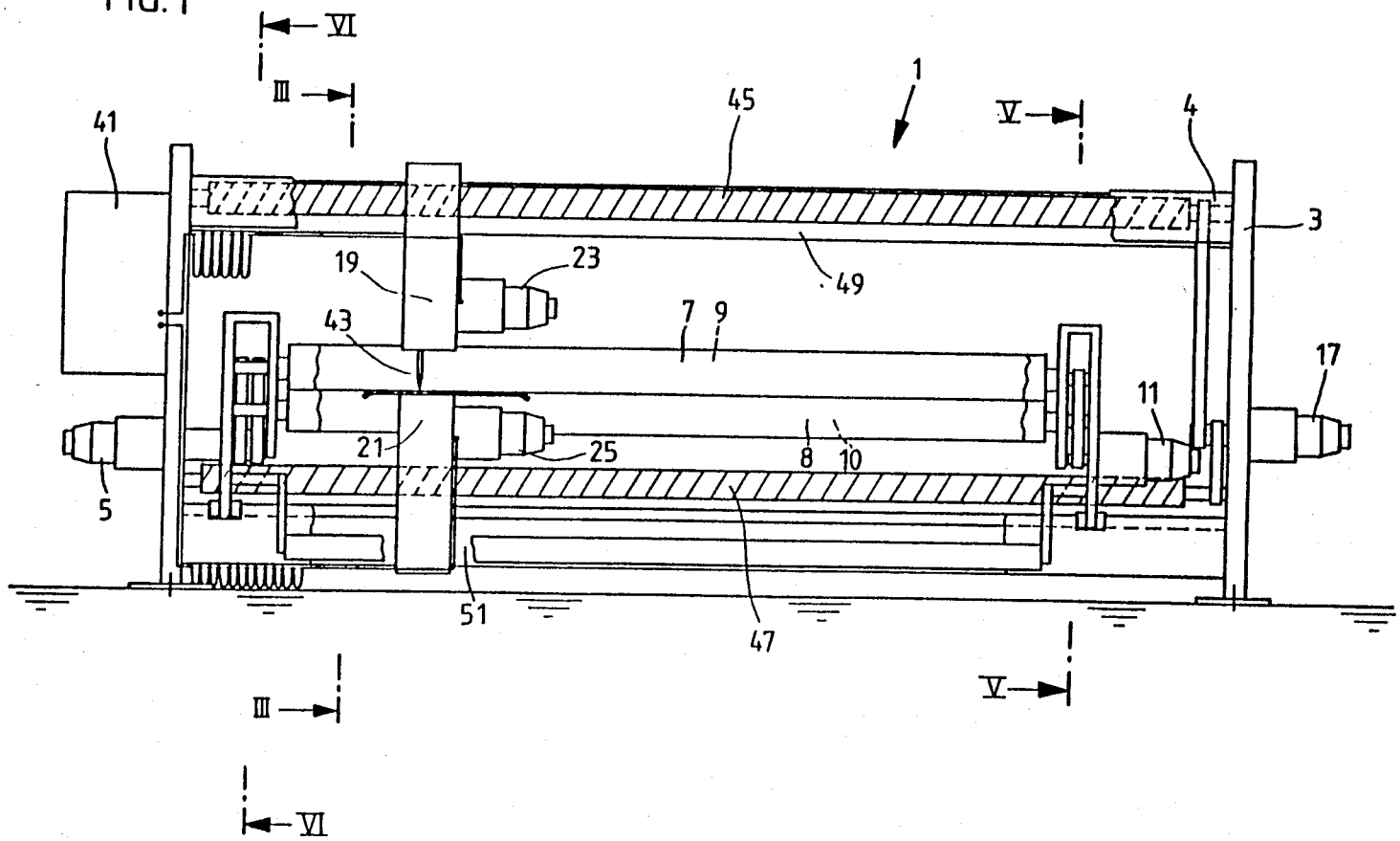
FIG. 1 is a side elevational view of a first sewing machine as seen from the left-hand side of FIG. 3, with certain parts broken away.
Figure 2:
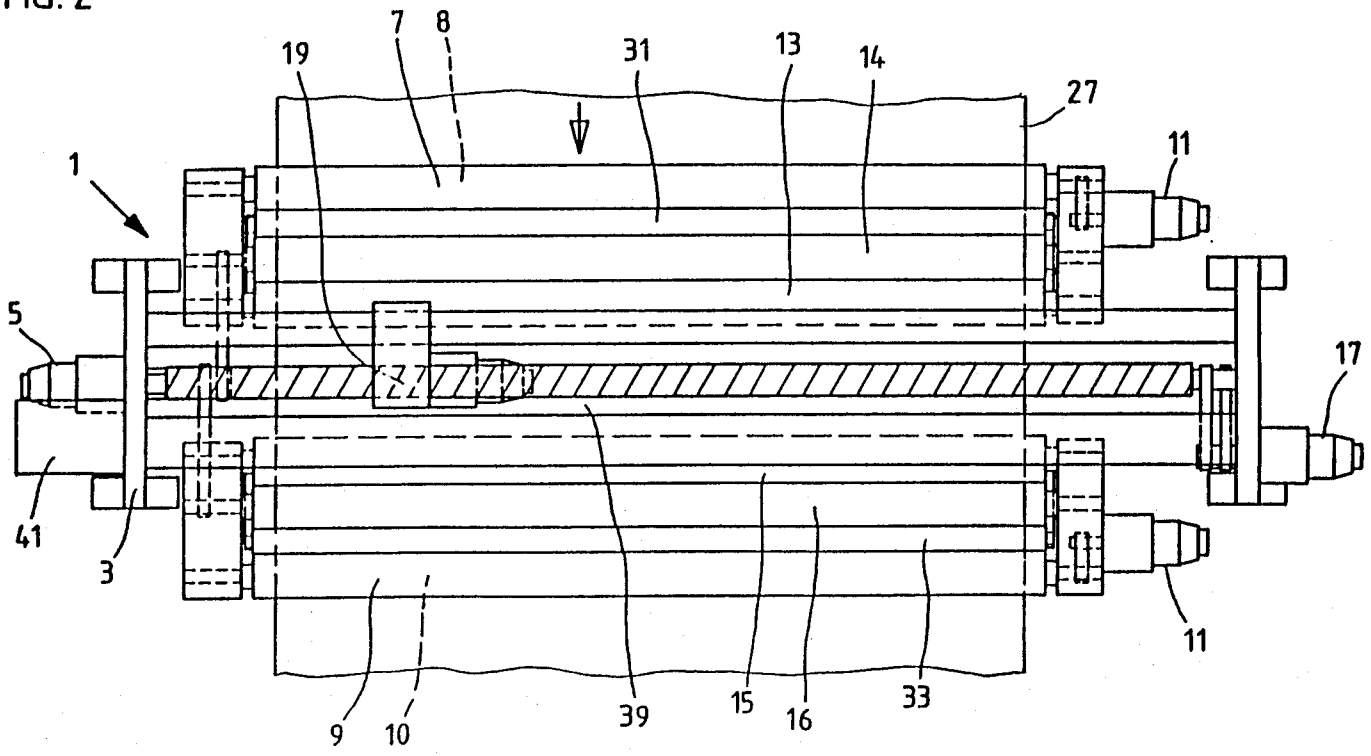
FIG. 2 is a fragmentary plan view of the sewing machine of FIG. 1.

FIGS. 1, 2, 3, 5 and 6 show certain details of a stitching machine which comprises a composite frame 3, tubular tie rods 4 between the front and rear sections of the frame, a first pair of rollers 7, 8 which are caused to bear against each other under the action of springs so as to define a nip for a workpiece 27 and which can be driven by a first motor 11, and a second pair of rollers 9, 10 which can be driven by a second intermittently operated motor 11 and are biased toward each other so as to define a second nip for the workpiece 27. The machine 1 further comprises a first advancing roll 14 which engages the workpiece 27 intermediate the rollers 7, 8 and a treating unit 39 at the thread-applying station of the machine, and a second advancing roll 16 which engages the workpiece 27 intermediate the treating unit 39 and the rollers 9, 10 of the second pair. In accordance with a presently preferred embodiment of the invention, the advancing roll 14 cooperates with a first additional advancing roll 13, and the advancing roll 16 cooperates with a second additional advancing roll 15. The rolls 13, 14 define a third nip, and the rolls 15, 16 define a fourth nip. The rolls 13, 14 are biased toward each other by suitable springs in a conventional way, e.g., in the same way as the rollers 7, 8, and the rolls 15, 16 are also biased toward each other by suitable springs in a conventional manner. The advancing manner rolls 13–16 are driven by a motor 5.

The needle mechanism 19 and the associated work gripping device 21 of the treating unit 39 are movable transversely of the path of movement of the workpiece 27 by a motor 17. The needle or needles 43 of the mechanism 19 are driven by a motor 23, and a separate motor 25 is provided to drive the mobile part or parts of the work gripping device 21. Each of the motors 23, 25 can constitute a variable-speed d-c motor. When in motion, the rollers 7, 8, 9, 10 and/or the rolls 13, 14, 15, 16 can be driven continuously or stepwise.

The workpiece 27 includes three discrete webs **27*a* which are stored in a source 29 including three discrete supply reels mounted in a separate housing adjacent to the frame 3. A work collecting device 53 in the form of a takeup reel is mounted on a separate upright adjacent to the frame 3 of the machine 1. The various rollers, rolls and pulleys on the frame 3 define for the webs 27*a*** and thereupon for the workpiece 27 an elongated path which extends from the source 29 to the collecting device 53.

In accordance with a presently preferred embodiment of the invention, the transmissions between the rollers 7, 8, 9, 10 and rolls 13, 14, 15, 16 on the one hand and the respective motors 11, 11 and 5 on the other hand include toothed pulleys and toothed belts so as to allow for accurate synchronizing of angular movements of various rollers and rolls. Such transmissions are shown schematically in FIGS. 5 and 6. Endless chains and sprocket wheels can be used in lieu of toothed belts and toothed pulleys.

A first dancing roll 31 (hereinafter called dancing pulley to distinguish from the rolls 13–16) is mounted on a pivotable support 35 intermediate the rollers 7, 8 and rolls 13, 14 so as to provide the workpiece 27 with a first loop 127 whose bight is normally located at a level below the common horizontal plane of the axes of the rollers 8, 10 i.e., below the common horizontal plane of the axes of the rollers 7, 9 and rolls 13–16. A second dancing pulley 35 is mounted on a pivotable support 37 in such a way that it provides the workpiece 27 with a second loop 227 whose bight is normally located at a level below the common plane of the axes of the rollers 8, 10.

Figure 3:
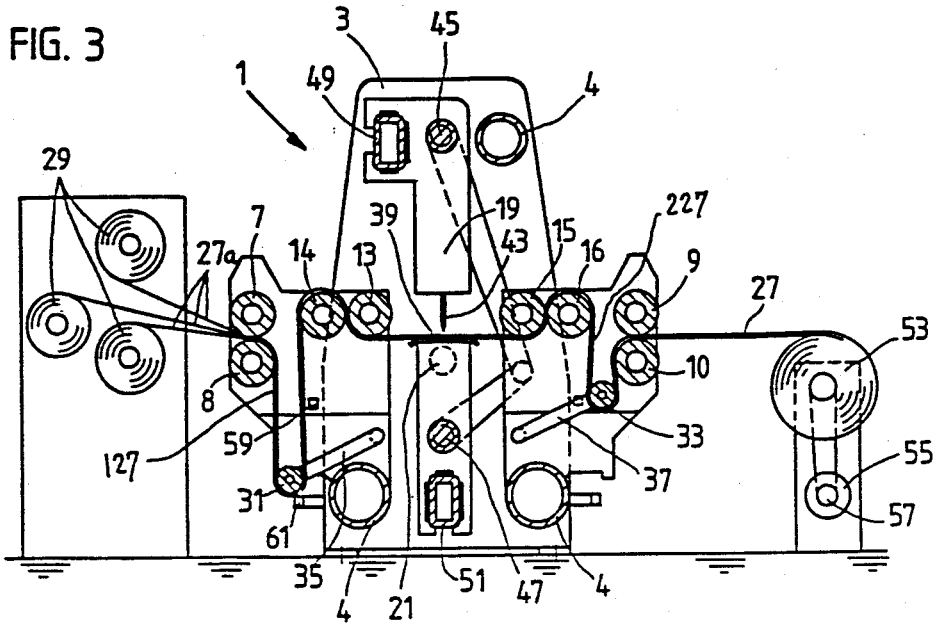
FIG. 3 is a transverse vertical sectional view as seen in the direction of arrows from the line III—III of FIG. 1.

Each of the dancing pulleys 31, 33 is an idler pulley which is free to rotate (clockwise and counterclockwise) about its horizontal axis. The three webs 27*a* of the workpiece 27 move into a common plane during travel through the nip of the rollers 7, 8 and such webs are stitched to each other during travel past the treating unit 39 of the machine 1. Each of the webs 27*a* can constitute a strip of textile material. If desired the advancing rolls 13, 14 and/or 15, 16 can be mounted one above the other rather than side-by-side as shown in FIG. 3. If the machine 1 is an embroidering machine, the needle mechanism 19 is designed to embroider into the webs 27*a* a pattern during travel of such webs past the treating station intermediate the rolls 13, 14 and 15, 16.

The motors 23, 25 are connected with the control circuit 41 of the machine 1 and receive signals in such a way that the operation of the gripping device 21 (motor 25) is synchronized with the operation of the needle mechanism 19 (motor 23). FIGS. 1 and 3 show a single needle 43 but the mechanism 19 can be equipped with several needles. The control circuit 41 resets the needle mechanism 19 and the gripping device 21 to their starting positions at the outset of a stitching operation. At such time, the needle 43 is held in its uppermost position. The gripper of the device 21 is thereupon synchronized before the machine 1 is started. The machine 1 is equipped with conventional means (not specifically shown) for monitoring the thickness, quality and/or other parameters of the workpiece 27 at the treating station and for transmitting to the control circuit 41 appropriate signals which are evaluated and thereupon used to compensate for detected fluctuations of the magnitude of forces acting upon the needle 43 and the gripper of the gripping device 21. This ensures accurate synchronization of the operation of the needle mechanism 19 with that of the gripping device 21 under a variety of different operating conditions.

The aforementioned motor 17 can drive two discrete feed screws 45, 47, one for moving the needle mechanism 19 transversely of the path of movement of the workpiece 27 and the other for imparting such movement to the gripping device 21 in synchronism with transverse movements of the mechanism 19. Otherwise stated, the motor 45 can move the needle mechanism 19 in parallelism with the nips which are defined by the rollers 7, 8 and 9, 10 as well as by the rolls 13, 14 and 15, 16, and the feed screw 47 moves the gripping device 21 in synchronism with movements of the mechanism 19 transversely of the path of forward or backward movement of the workpiece 27 at the treating station between the advancing rolls 13, 14 and 15, 16. The operation of the feed screw 45 is synchronized with the operation of the feed screw 47 by the control unit 41 which is connected with the motor 17. The feed screws 45, 47 are mounted in or on horizontal guide rails 49 and 51 which are disposed above and below the rollers 7–10 and rolls 13–16, respectively. The arrangement is such that the nut which carries the needle mechanism 19 mates with the upper feed screw 45 without any play or without any noticeable play, and the same applies for the nut which carries the gripping device 21 and mates with the lower feed screw 45. If desired, the feed screw 45, 47 can be replaced with steel cables, steel belts, endless chains or other suitable means for transmitting motion from the motor 17 to the needle mechanism 19 and gripping device 21.

The mode of operation of the stitching machine 1 is as follows:

Convoluted supplies of three discrete webs 27*a* are mounted on the corresponding spindles to form the source 29 at one side of the frame 3. The leader of the workpiece 27 (i.e., of a composite web including the three webs 27*a*) is affixed to the core of the (then empty) takeup reel 53. The latter can be driven by a motor 55 through the intermediary of a friction clutch 57. The advancing rolls 13, 14 clamp the workpiece 27 upstream of the treating unit 39 and the rolls 15, 16 clamp the workpiece downstream of the treating unit so that the portion of the workpiece between the nips of the advancing rolls 13, 14 and 15, 16 is maintained under requisite tension. The speed at which the rolls 13–16 advance the workpiece 27 forwardly or backwards is determined by the circuit 41 which controls the motor 5 for the rolls 13–16. The workpiece 27 is further clamped in the nip of the rollers 7, 8 as well as in the nip of the rollers 9, 10. The clamping action of rollers 7, 8 and 9, 10 is sufficient to ensure that the length of the loop 127 decreases (and the length of the loop 227 increases at the same time) when the rolls 13, 15 are driven counterclockwise (or the rolls 14, 16 are driven clockwise) in order to move forwardly, i.e., toward the takeup reel 53, that portion of the workpiece 27 which is disposed between the rollers 7, 8 and 9, 10. By the same token, the length of the loop 127 increases proportionally with a reduction of the length of the loop 227 when the rolls 14, 16 and/or 13, 15 are caused to advance the workpiece portion between the rollers 7, 8 and 9, 10 in the opposite direction, namely toward the source 29. The supports 33, 37 for the dancing pulleys 31, 33 are biased so as to tension the respective loops 127, 227. The arrangement is preferably such that, if the mass of the pulley 31 and of the pivotable portion of the support 35 matches the mass of the pulley 33 and of the pivotable portion of the respective support 37, the tensioning of the loop 127 matches that of the loop 227. Consequently, the magnitude of forces acting upon the workpiece portion which is located at the station for the treating unit 39 is the same regardless of whether the rolls 13–16 move such portion of the workpiece forwardly or backwards. The force with which the pulley 31 draws the workpiece portion immediately to the left of the nip of the advancing rolls 13, 14 is the same as that which tends to draw the workpiece portion immediately downstream of the nip of the advancing rolls 15, 16. The only difference between the magnitudes of forces acting upon the loops 127 and 227 is that the pulley 31 or 33 must be accelerated during each start of forward movement of the workpiece 27 from the nip of the rolls 13, 14 toward the nip of the rolls 15, 16 or during forward movement of the workpiece from the nip of the rolls 15, 16 toward the nip of the rollers 9, 10.

When the machine 1 is in continuous or substantially uninterrupted use, the length of the loop 127 must be increased from time to time by intermittently driving the roller 7 and/or 8 in a direction to draw webs *27a* from the respective reels of the source 29. Analogously, the length of the loop 227 must be reduced by intermittently driving the roller 9 and/or 10 so as to advance a certain length of the workpiece toward the takeup reel 53 which collects such length of the workpiece under the action of the motor 55. The motor 11 for the roller 7 and/or 8 as well as the motor 11 for the roller 9 and/or 10 can be started and arrested automatically at appropriate intervals. To this end, the machine 1 comprises actuating elements in the form of limit switches 59, 61 which are adjacent to the path of pivotal movement of the support 35 for the pulley 31. The upper switch 59 starts the motor 11 for the roller 7 and/or 8 when the size of the loop 127 is reduced to a minimum acceptable value, and the switch 61 arrests the motor 11 for the roller 7 and/or 8 when the length of the loop 127 is increased to its maximum acceptable value. Analogous switches (not specifically shown) can be provided adjacent to the path of movement of the support 37 for the pulley 33 to control the operation of the motor 11 for the roller 9 and/or 10. The switches 59, 61 are connected with the circuit 41 which controls the operation of the motors 11 for the rollers 7, 8 and 9, 10. The switch 61 is omitted if each signal from the switch 59 starts a time delay unit which maintains the motor 11 for the roller 7 and/or 8 in operation for a preselected interval of time which suffices to replenish the supply of workpiece material between the rollers 7, 8 and the advancing rolls 13, 14. The same applies for the operation of the motor 11 for the roller 9 and/or 10. The switch or switches which control the operation for the motor 11 for the roller 9 and/or 10 are connected with the control circuit 41 in such a way that the latter starts the motor 11 for the roller 9 and/or 10 when the length of the loop 227 reaches a maximum acceptable value and that the motor 11 for the roller 9 and/or 10 is arrested when the length of the loop 227 is reduced to a minimum acceptable value.

Figure 4:
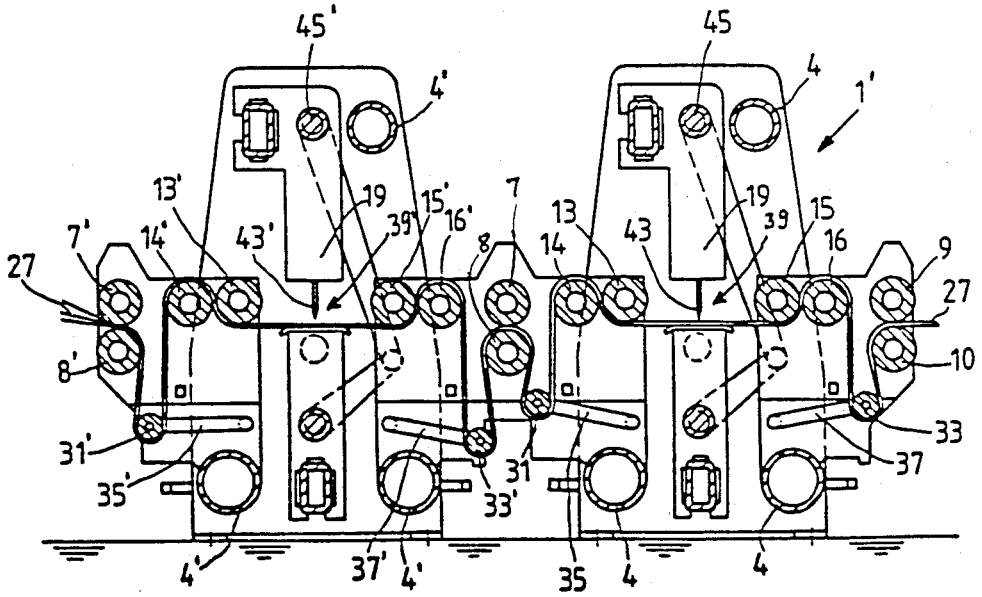
FIG. 4 is a similar transverse vertical sectional view of a modified sewing machine with two treating units.
Figure 5:
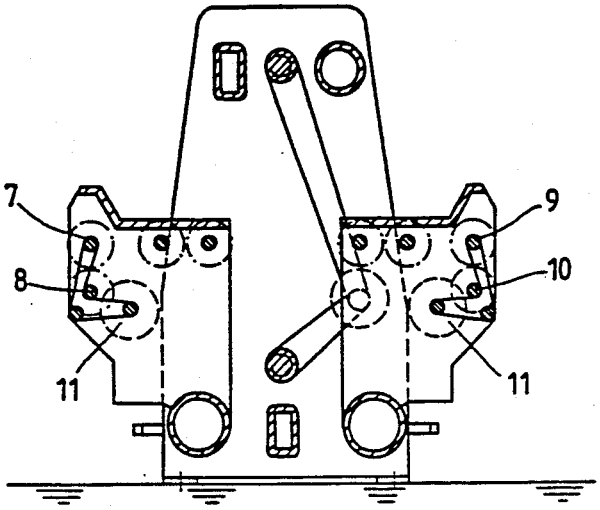
FIG. 5 is a transverse vertical sectional view as seen in the direction of arrows from the line V—V of FIG. 1.
Figure 6:
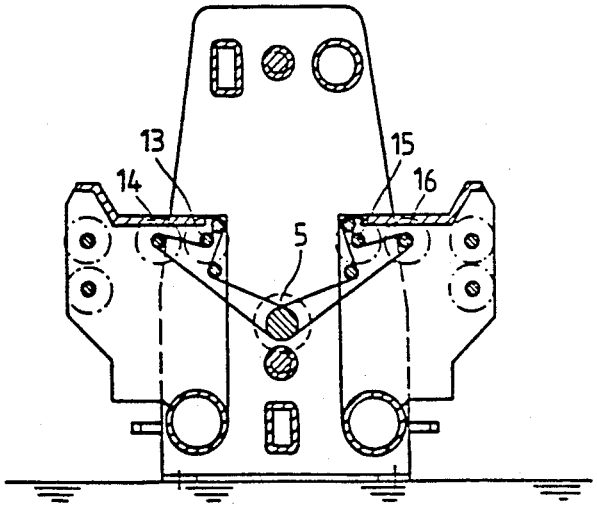
FIG. 6 is a transverse vertical sectional view as seen in the direction of arrows from the line VI—VI of FIG. 1.

FIG. 4 shows a portion of a modified stitching machine 1' whose frame carries two treating units 39, 39'. The parts which are added in view of the provision of two series-arranged treating units are denoted by reference numerals corresponding to those used in FIG. 3 plus a prime. Thus, the machine 1' comprises a third pair of rollers 7', 8' upstream of the second treating unit 39' and downstream of the source (not shown) of the workpiece 27, two further advancing rolls 13', 14' upstream of the treating unit 39' and downstream of the rollers 7', 8', a third pulley 31' with support 35' intermediate the rollers 7', 8' and advancing rolls 13', 14', a fourth pair of advancing rolls 15', 16' between the treating unit 39' and the rollers 7, 8 (which, as far as the treating unit 39' is concerned, perform the function of rollers 9, 10 shown in FIG. 3), and a fourth pulley 33' with a support 37' between the rolls 15', 16' and rollers 7, 8. If desired, a fifth dancing pulley (not shown) can be installed between the rollers 7, 8 and an additional pair of rollers (between the rollers 7, 8 and pulley 33' or 31) in order to enlarge the supply of workpiece material between the treating units 39 and 39'.

It is further clear that the treating unit 39 or 39' of FIG. 4 can be replaced with a different unit, i.e., that the improved machine can be used to perform different types of sewing operations upon successive increments of a workpiece. For example, the treating unit 39 can be designed to form transverse stitches and the treating unit 39' can be designed to form longitudinal stitches or vice versa.

An important advantage of the improved sewing machine is that the magnitude of forces which are attributable to inertia of the workpiece 27 and act in the region of the treating unit 39 and/or 39' is reduced to a minimum as well as that the circumstances prevailing during forward and rearward transport of the workpiece portion between the adjacent pairs of advancing rolls at each of the treating stations are at least substantially identical. This renders it possible to provide the workpiece with a series of identical patterns. Such advantages are believed to be attributable to mirror symmetrical distribution of advancing rolls and dancing pulleys with reference to a vertical plane crossing the path of the workpiece at the treating station 39 and/or 39'. This ensures the establishment of identical conditions, not only as regards the tensioning of the workpiece but also as concerns the inertia of machine parts acting upon the workpiece at the station for the unit 39 and/or 39', regardless of whether the workpiece is caused to move forwardly or backwards. Moreover, the improved sewing machine renders it possible to eliminate the influence upon the treatment of the workpiece of all those variables which are attributable to the mass, diameter and/or other parameters of the supplies of workpiece material at the source 29 and/or at the collecting station (reel 53).

A further important advantage of the improved sewing machine is that the mass of the needle mechanism 19 as well as of the gripping device 21 is small so that the components 19 and 23 (together with their motors 23, 25) can be moved transversely of the path of the workpiece 27 in exact synchronism with each other and without necessitating the provision of a chamber or compartment for the component 19 and/or 21 at the one or the other end of its path transversely of the workpiece. All this applies regardless of whether the machine is of the type which applies double-lock stitches or chain stitches.

A control circuit which can be used in the sewing machine of the present invention is the "LBR Digital Linear Continuous Pass Control" manufactured by SQUARE D GmbH, Landwehrstrasse 48, D-6100 Darmstadt, Western Germany.

The biasing means used for pressing together the pairs of rollers 7–10 and 13–16 can be made as shown in the German Auslegeschrift No. 1 101 115 (FIG. 1).

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. In a machine for applying stitches to an elongated workpiece, the combination of a frame; a source arranged to pay out the workpiece; a work collecting device arranged to receive the workpiece which is being paid out by said source; treating unit provided in said frame; and means for guiding and advancing the workpiece along an elongated path intermediate said source and said collecting device and past said unit, said guiding and advancing means being installed in said frame and including a first pair of rollers defining for the workpiece a first nip intermediate said source and said unit, a second pair of rollers defining for the workpiece a second nip intermediate said unit and said collecting device, a first advancing roll arranged to advance the workpiece forwardly and backwards intermediate the rollers of said first pair and said unit, a second advancing roll arranged to advance the workpiece forwardly and backwards intermediate said unit and the rollers of said second pair, a first dancing pulley arranged to provide the workpiece with a first loop intermediate the rollers of said first pair and said first advancing roll, and a second dancing pulley arranged to provide the workpiece with a second loop intermediate said second advancing roll and the rollers of said second pair.

2. The combination of claim 1, wherein said guiding and advancing means further comprises a first additional advancing roll defining with the first advancing roll a third nip for the workpiece, and a second additional advancing roll defining with the second advancing roll a fourth nip for the workpiece.

3. The combination of claim 1, further comprising motor means for said advancing rolls, means for supporting said dancing pulleys so that each of said pulleys is movable along a discrete path in response to a lengthening or shortening of the respective loop, and means for controlling the operation of said motor means, including actuating elements adjacent to at least one of said discrete paths.

4. The combination of claim 1, wherein said advancing rolls are disposed at the same level.

5. The combination of claim 2, further comprising stepping motor means for driving said rolls in synchronism.

6. The combination of claim 1, wherein said treating unit comprises at least one mobile needle at one side of said path, at least one mobile work gripping device at the other side of said path, first drive means for said needle, second drive means for said gripping device, and means for synchronizing the operation of said first drive means with the operation of said second drive means.

7. The combination of claim 6, wherein said needle is movable transversely of said path.

8. The combination of claim 7, wherein said gripping device is movable transversely of said path, and further comprising means for moving said needle and said gripping device transversely of said path in synchronism with each other.

9. The combination of claim 8, wherein said moving means comprises at least one feed screw.

10. The combination of claim 8, wherein said moving means comprises at least one chain.

11. The combination of claim 8, wherein said moving means comprises at least one metallic band.

12. The combination of claim 1, further comprising a second treating unit adjacent said path intermediate said collecting device and the rollers of said second pair.

13. The combination of claim 1, further comprising a second treating unit adjacent said path intermediate said source and the rollers of said first pair.

14. The combination of claim 13, further comprising a third pair of rollers defining for the workpiece a nip intermediate said source and said second unit, a third advancing roll arranged to advance the workpiece forwardly and backwards intermediate the rolls of said third pair and said second unit, a fourth advancing roll arranged to advance the workpiece forwardly and backwards intermediate said second unit and the rollers of said first pair, a third dancing pulley arranged to provide the workpiece with a loop intermediate the rollers of said third pair and said third advancing roll, and a fourth dancing pulley arranged to provide the workpiece with a loop intermediate said fourth advancing roll and the rollers of said first pair.

15. The combination of claim 1, wherein said source comprises a plurality of supply reels each arranged to feed a discrete portion of the workpiece into said path.

16. The combination of claim 1, wherein said advancing rolls and one each of said first and second pairs of rollers have substantially horizontal axes disposed in a common substantially horizontal plane.

* * * * *